US008256872B2

(12) United States Patent
Scanlan

(10) Patent No.: US 8,256,872 B2
(45) Date of Patent: Sep. 4, 2012

(54) INKJET CARTRIDGE PRINTHEAD SEALING BAND

(75) Inventor: David Scanlan, Lakewood Ranch, FL (US)

(73) Assignee: Phoenix Ink Corporation, Sarasota, FL (US)

( * ) Notice: Subject to any disclaimer, the term of this patent is extended or adjusted under 35 U.S.C. 154(b) by 257 days.

(21) Appl. No.: 12/783,061

(22) Filed: May 19, 2010

(65) Prior Publication Data

US 2011/0285796 A1 Nov. 24, 2011

(51) Int. Cl.
*B41J 2/165* (2006.01)

(52) U.S. Cl. ..... 347/29

(58) Field of Classification Search ..... 347/20, 347/22, 29

See application file for complete search history.

(56) References Cited

U.S. PATENT DOCUMENTS

| | | | | |
|---|---|---|---|---|
| 5,262,802 | A * | 11/1993 | Karita et al. | 347/87 |
| 6,481,825 | B1 | 11/2002 | Hinami et al. | |
| 6,588,875 | B1 | 7/2003 | Kleinhammer | |
| 7,611,222 | B2 * | 11/2009 | Cray et al. | 347/29 |
| 7,871,148 | B2 * | 1/2011 | Scanlan | 347/29 |
| 2010/0177140 | A1 * | 7/2010 | Scanlan | 347/29 |

* cited by examiner

*Primary Examiner* — Huan Tran

(74) *Attorney, Agent, or Firm* — McDermott Will & Emery LLP

(57) ABSTRACT

An inkjet cartridge printhead seal comprises an elastomeric band and a seal portion. The elastomeric band includes an outer perimeter and an inner perimeter. The seal portion is disposed along a portion of the band. The seal portion connects to the inner perimeter of the elastomeric band. The seal portion has a sealing surface with a partially spherical-shape. The elastomeric band comprises an inkjet cartridge attaching portion disposed opposite the seal portion. The inkjet cartridge attaching portion has a generally flat surface.

20 Claims, 3 Drawing Sheets

INKJET CARTRIDGE PRINTHEAD SEALING BAND

TECHNICAL FIELD

The present disclosure relates to an inkjet cartridge printhead seal. Specifically, the present disclosure relates to a universal sealing band for sealing the printhead while it is being filled or refilled, shipped, stored or otherwise not installed in a printer.

BACKGROUND

Inkjet printers are widely used. These printers utilize cartridges containing ink. The ink is ejected from print head nozzles located on the cartridge, and laid onto paper or other media. The cartridge may contain ink of a single color, or may contain multiple inks of different colors to create color images. Used or spent inkjet cartridges may be refilled with ink and reused. The nozzles should be sealed whenever the cartridge is not installed in the printer in order to prevent the ink from drying and blocking the nozzles. In particular, the nozzles must be sealed when the cartridge is being refilled.

Several types of inkjet cartridge storage and seal containers are known in the art. For example, U.S. Pat. No. 6,588,875 to Kleinhammer discloses an inkjet cartridge printhead seal comprising an elastomeric seal and a flexible sheet with an adhesive on one side which holds the seal compressed against an inkjet cartridge printhead nozzle plate.

However, the prior art does not teach a simplified, unitary inkjet cartridge printhead seal. For example, the printhead seal disclosed by Kleinhammer is comprised of several components, including a sheet of flexible material coated with an adhesive, a seal, a release liner, and a finger pull tab. Assembling the seal out of these components may be costly and time-consuming. Furthermore, in order to install Kleinhammer's printhead seal, it is necessary to remove the release liner, align the seal with the nozzle plate, and press the adhesive surface against the sides of the cartridge with enough force to generate a secure seal. This method is vulnerable to misalignment of the seal with the nozzle plate, and incomplete sealing of the adhesive to the cartridge. Any mistake in installation would lead to the ink spilling or drying when the cartridge is subsequently shipped or stored.

Accordingly, there is a need for a unitary, nearly universal inkjet printhead seal that is easy to manufacture and install.

SUMMARY

According to one embodiment, an inkjet cartridge printhead seal comprises an elastomeric band and a seal portion. The elastomeric band includes an outer perimeter and an inner perimeter. The seal portion is disposed along a portion of the band. The seal portion connects to the inner perimeter of the elastomeric band. The seal portion has a sealing surface with a partially spherical-shape. The elastomeric band comprises an inkjet cartridge attaching portion disposed opposite the seal portion. The inkjet cartridge attaching portion has a generally flat surface.

According to another embodiment, an inkjet cartridge printhead seal comprises a unitary elastomeric band. The unitary elastomeric band forms an inkjet cartridge attaching portion and a seal portion. The seal portion forms a sealing surface deflectable from a partially spherical shape to a generally flat shape when the elastomeric band is placed over an inkjet cartridge to seal a nozzle plate of the inkjet cartridge.

The inkjet cartridge attaching portion has a width that is narrower than a width of the sealing surface.

According to a further embodiment, an inkjet cartridge printhead seal comprises an elastomeric band, a seal portion, and a connecting rib. The elastomeric band includes an outer perimeter and an inner perimeter. The elastomeric band has a depression formed that reduces a diameter of both the inner perimeter and the outer perimeter. The seal portion has a sealing surface, a generally flat band connecting surface opposite the sealing surface, a first seal portion wall connecting the sealing surface to the generally flat band connecting surface, and a second seal portion wall generally opposite the first seal portion wall, the second seal portion wall connects the sealing surface to the generally flat band. The connecting rib is disposed between the elastomeric band and the seal portion.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by the features particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

Figure 1:
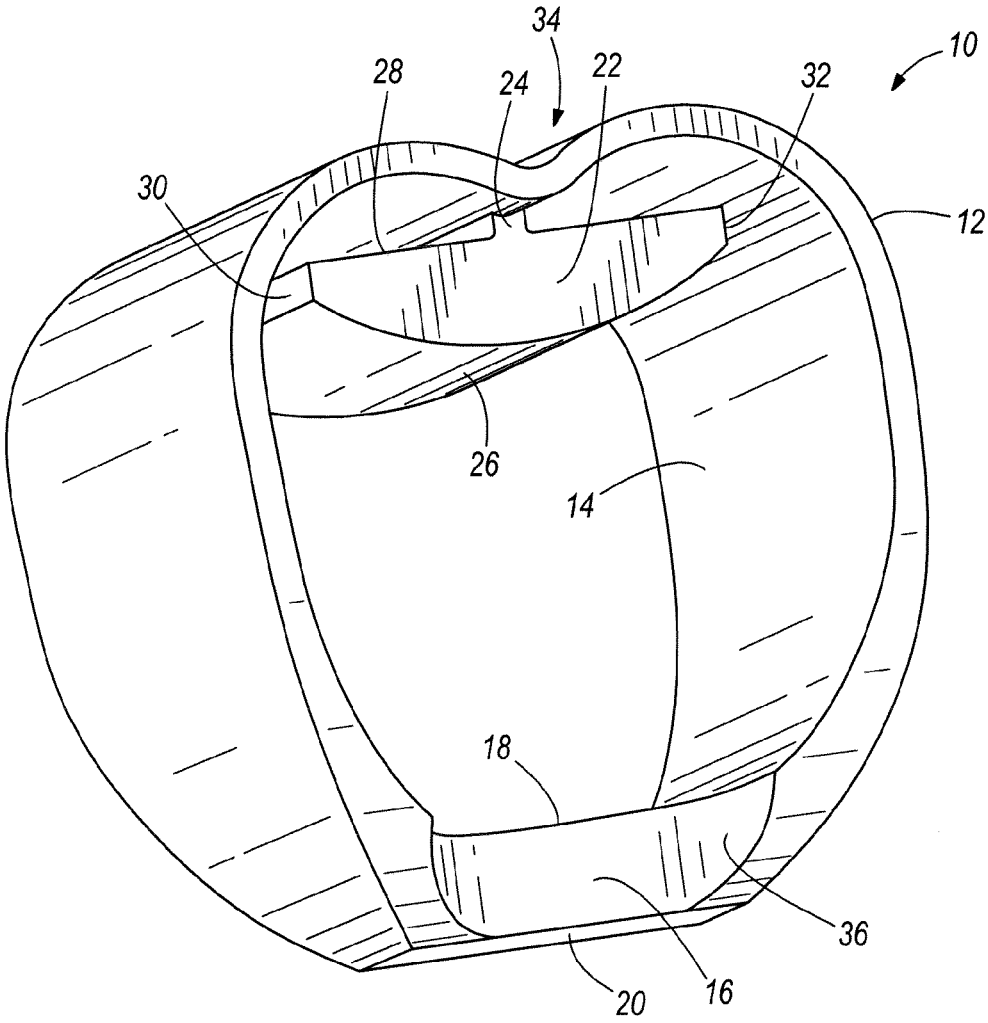
FIG. 1 shows a perspective view of an inkjet cartridge printhead sealing band.
Figure 2:
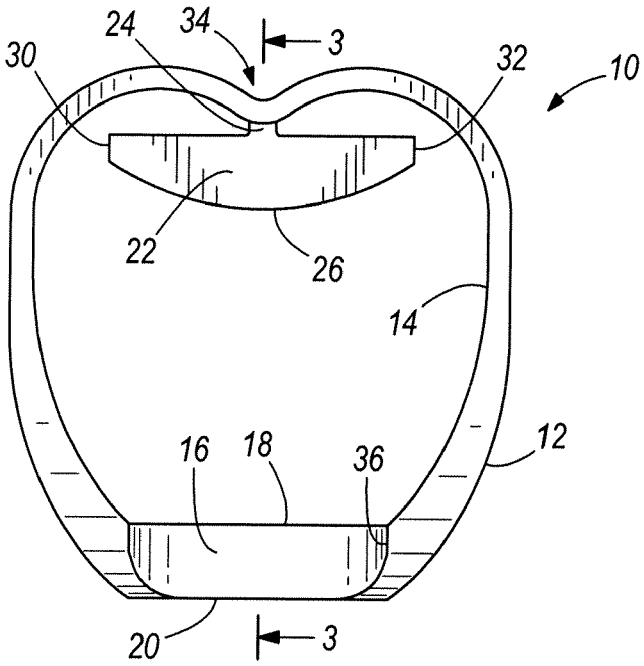
FIG. 2 is a side view of the inkjet cartridge printhead sealing band of FIG. 1.
Figure 3:
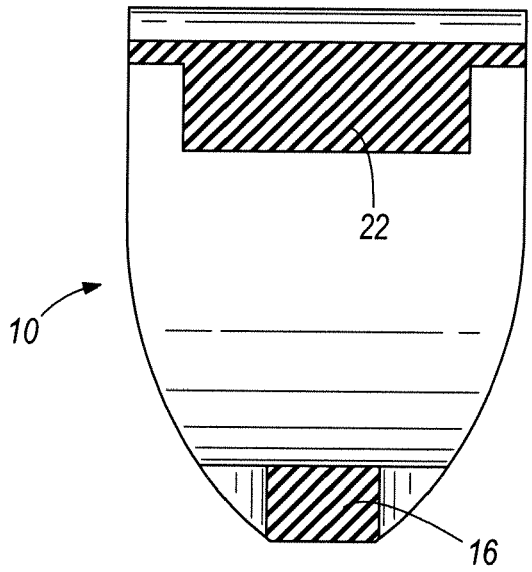
FIG. 3 is a cross-sectional view taken through line A-A of FIG. 2.
Figure 4:
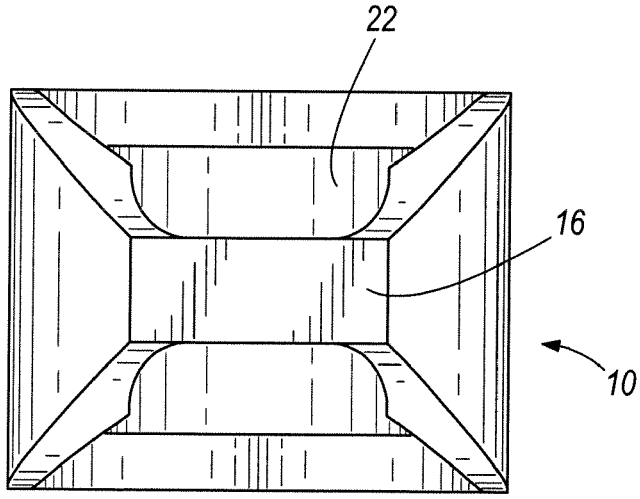
FIG. 4 is a bottom view of the inkjet cartridge printhead sealing band of FIG. 1.

It is contemplated that the subject matter described herein may be embodied in many forms. Accordingly, the embodiments described in detail below are the presently preferred embodiments, and are not to be considered limitations.

The universal sealing band 10, shown in FIGS. 1-4 is elastomeric. In embodiments of the present invention, the universal sealing band 10 of the present invention comprises a polymeric material or a mixture of polymeric and non-polymeric materials. It is to be understood that the universal sealing may be made in a number of different shapes, sizes, colors or grades of band for sealing the printhead while it is being filled or refilled, shipped, stored or otherwise not installed in a printer.

More specifically, the universal sealing band 10 may be made from polymeric materials such as elastomers. Elastomeric materials useful in the practice of the invention are exemplified, but not limited to, polysiloxanes and natural or synthetic latex.

Polysiloxanes are defined as polymers in which their backbones consist of Si—O—Si units. Polysiloxanes are also referred to as silicone rubbers. A preferred polysiloxane for the practice of this invention is polydimethyl methyl vinyl silicone.

A latex refers to a stable dispersion (emulsion) of polymer microparticles in an aqueous medium. Latexes may be categorized as either natural or synthetic. Synthetic latex is made by polymerizing a monomer that has been emulsified with surfactants. Natural latex is found in the milky sap of many plants that coagulates on exposure to air.

Of course, other polymeric materials such as thermoplastic materials are also contemplated by the present invention.

The universal sealing band 10 of the present invention may also comprise, in addition to the polymeric materials described above, other materials which may be exemplified, but not limited to silicon dioxide ($SiO_2$), substituted silicon compounds, DCBP (2,4-dichlorobenzoyl peroxide), and DBPMH (2,5-dimethyl-2,5-di[t-butylperoxy]hexane). The addition of these materials in the manufacturing of the universal sealing band will, of course, be depended on the requirements of the final product.

In the present invention, the material used to make the universal sealing band 10 possesses certain physical characteristics. These physical characteristics can be exemplified, but not limited to, elasticity and hardness of material.

Elasticity may be defined as the ability of material used to construct the sealing band to be stretched without breaking or tearing.

The hardness of a material is defined as the material's resistance to permanent indentation. The measurement of hardness in polymers, elastomers and rubbers is obtained by the use of a durometer device.

Durometry, like many other hardness tests, measures the depth of an indentation in the material created by a given force on a standardized presser foot. This depth is dependent on the hardness of the material, its viscoelastic properties, the shape of the presser foot, and the duration of the test. ASTM D2240 durometers allow for a measurement of the initial hardness, or the indentation hardness after a given period of time The basic test requires applying the force in the consistent manner, without shock measuring the hardness (depth of the indentation). If a timed hardness is desired, force is applied for the required time and then read.

The final value of the hardness depends on the depth of the indenter. If the indenter penetrates 2.5 mm or more into the material, the durometer number is 0 for that scale. If it does not penetrate at all, then the durometer number is 100 for that scale. It is for this reason that multiple scales exist. The durometer measurement or number value is a dimensionless quantity, and there is no simple relationship between a material's durometer measurement in one scale, and its durometer measurement in any other scale, or by any other hardness test.

It has been found that materials which have durometer measurement of between about 10 to 40 and preferably about 20 are well suited for use with the band 10 of FIGS. 1-4.

The value may vary depending upon the size of the band to be used, which may be dictated by the size or shape of the cartridge with which it is to be used. For typical size inkjet cartridges, it has been found that about 20 durometer works well.

As shown, the elastomeric band 10 has an outer perimeter 12, and an inner perimeter 14. The band 10 has an inkjet cartridge attaching portion 16. The inkjet cartridge attaching portion 16 has a first generally flat surface 18 and a second generally flat surface 20. The first generally flat surface 18 contacts a portion of an inkjet cartridge 40 (FIG. 5) to secure the band 10 to the inkjet cartridge 40. The first generally flat surface 18 is formed along the inner perimeter 14 of the band 10, while the second generally flat surface 20 is formed along the outer perimeter 12 of the band 10.

The band 10 additionally comprises a seal portion 22. The seal portion 22 connects to the inner perimeter 16 of the band 10 via a connecting rib 24. It is contemplated that the seal portion 22 and the connecting rib 24 are integrally formed with the band 10 and are, therefore, made of the same material as the band 10. The seal portion 22 has a sealing surface 26 that has a curved or partially spherical shape. The seal portion 22 additionally has a generally flat band connecting surface 28. A first seal portion wall 30 and a second seal portion wall 32 connect the sealing surface 26 to the band connecting surface 28 on each side of the seal portion 22. The connecting rib 24 connects to the seal portion 22 at a location on the band connecting surface 28, generally at a location generally equidistant between the first seal portion wall 30 and the second seal portion wall 32. The thickness of the seal portion 22 varies based on the curvature of the sealing surface 26. As shown, the seal portion 22 is narrowest near the first seal portion wall 30 and the second seal portion wall 32, and is generally widest at the midpoint between the first seal portion wall 30 and the second seal portion wall 32.

The band 10 has a depression 34 formed near the portion of the band 10 where the connecting rib 24 connects the seal portion 22 to the band 10. The depression 34 makes the band 10 somewhat generally heart-shaped when not in place over an inkjet cartridge. The depression 34 is provided to allow the band 10 to stretch such that the sealing surface 26 may deform to a generally flat shape over an inkjet print cartridge 40, as shown in FIG. 6. In this way a nozzle plate 42 (FIG. 5) of the inkjet print cartridge 40 may be covered by the seal portion 22 in a manner to effectively seal the nozzle plate 42 and prevent ink from leaking from the inkjet print cartridge 40.

The band 10 additionally narrows in width from the seal portion 22 to the inkjet cartridge attaching portion 16. It is contemplated that the width of the band 10 near the seal portion 22 may be from about 25 to about 30 mm, while the width of the band 10 near the inkjet cartridge attaching portion 16 may be from about 5 to about 10 mm.

The band 10 may additionally have a first indentation 36 located on a first side of the band 10 and a second indentation, not shown (a mirrored version of the first indention 36), located on the second side of the band 10 near the inkjet cartridge attaching portion 16. The first indentation 36 and the second indentation reduce the width of the inkjet cartridge attaching portion 16.

The seal portion 22 has a width that is generally less than the width of the band 10 adjacent the seal portion 22. For example, it is contemplated that the seal portion 22 may be from about 5 mm to about 10 mm narrower than the band 10 adjacent the seal portion 22.

As shown in FIGS. 1-4, the band 10 has a thickness of from about 1.25 to about 1.75 mm over most of the band 10, and transitions gradually to a thickness of about 5 mm in the inkjet cartridge attaching portion 16. The thickness of the seal portion 22 of the band 10 is about 7 mm. The thickness of the seal portion 22 may vary based on the porosity of the material used to make the band 10.

Figure 5:
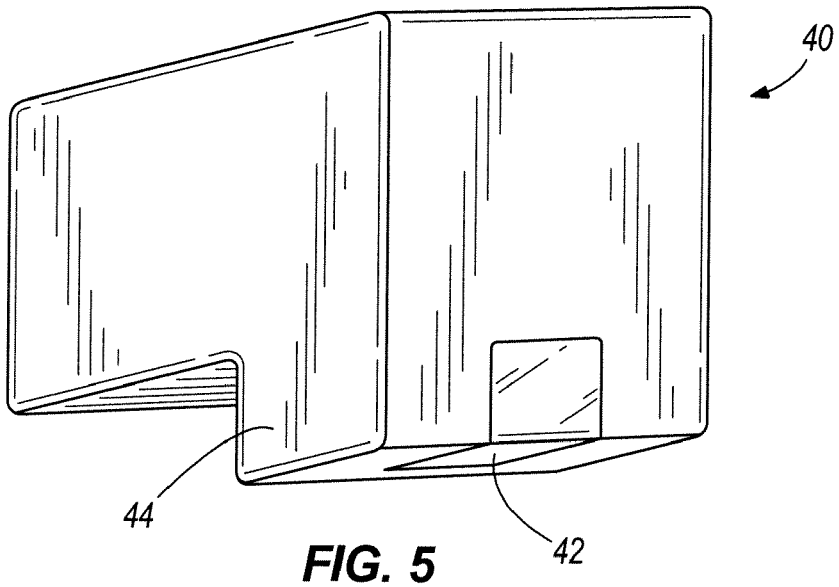
FIG. 5 shows a perspective view of a prior art inkjet cartridge.
Figure 6:
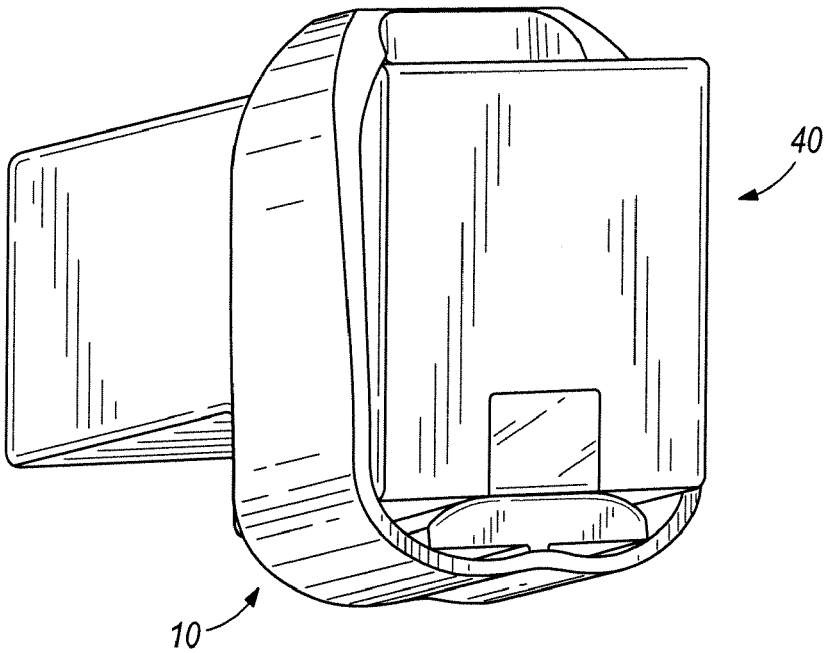
FIG. 6 shows a perspective view of the sealing band of FIG. 1 used with the inkjet cartridge of FIG. 5.

The dimensions listed herein are exemplary and may vary depending on the elasticity of the elastomeric material, the porosity of the elastomeric material, the size of the inkjet cartridge, the size of the nozzle plate Turning now to FIG. 5, an inkjet cartridge 40 is shown having a shoulder-like protrusion 44 surrounding the nozzle plate 42. The dimensions of this protrusion may vary between different brands and models of cartridges. The example of the band 10 shown in FIGS. 1-4 is sized to fit most existing brands of cartridges. Accordingly, to provide a nearly universal fit, the band 10 may have a seal portion 22 having a width that is greater than the width of known print head nozzle plate 42 and shoulder-like protrusion 44.

As shown in FIG. 6, the elastomeric material of the band 10 stretches when applied to the inkjet cartridge 40. Once in use, the band 10 fits snugly around the inkjet cartridge 40, compressing the seal portion 22 against the nozzle plate 42. The depression 34 of the band 10 has been flattened and sealing surface 26 of the seal portion 22 has additionally been flattened. However, the flat band connecting surface 28 now has a partially spherical shape. The sealing surface 26 contacts the nozzle plate 42 and forms a seal over the nozzle plate 42. The inkjet cartridge attaching portion 16 of the band 10 contacts a surface of the inkjet cartridge opposite the nozzle plate 42 to assist in the securing of the band 10 to the inkjet cartridge 40.

The foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents fall within the scope of the invention.

What is claimed is:

1. An inkjet cartridge printhead seal comprising:

an elastomeric band including an outer perimeter and an inner perimeter; and a seal portion being disposed along a portion of the band, the seal portion connecting to the inner perimeter of the elastomeric band and the seal portion having a sealing surface with a partially spherical shape;

wherein the elastomeric band comprises an inkjet cartridge attaching portion disposed opposite the seal portion, the inkjet cartridge attaching portion having a generally flat surface.

2. The inkjet cartridge printhead seal of claim 1, wherein the elastomeric band comprises a polymer having a silicone backbone.

3. The inkjet cartridge printhead seal of claim 2, wherein the elastomeric band comprises polydimethyl methyl vinyl silicone rubber.

4. The inkjet cartridge printhead seal of claim 1, wherein a connecting rib protrudes from the inner perimeter of the elastomeric band to the seal portion, the connecting rib attaching the seal portion to the elastomeric band.

5. The inkjet cartridge printhead seal of claim 4, wherein the connecting rib connects to the sealing portion in a generally flat band connecting surface.

6. The inkjet cartridge printhead seal of claim 4, wherein the elastomeric band forms a depression on the elastomeric band where the connecting rib attaches to the elastomeric band.

7. The inkjet cartridge printhead seal of claim 1, wherein the seal portion has a width of from generally about 20 mm to generally about 25 mm.

8. The inkjet cartridge printhead seal of claim 1, wherein the inkjet cartridge attaching portion as a width of from generally about 5 mm to generally about 10 mm.

9. The inkjet cartridge printhead seal of claim 1, wherein the elastomeric band has a width of generally from about 25 mm to generally about 30 mm.

10. The inkjet cartridge printhead seal of claim 1, wherein the seal portion is narrower than a maximum width of the elastomeric band.

11. The inkjet cartridge printhead seal of claim 1, wherein the seal portion is wider than the inkjet cartridge attaching portion.

12. An inkjet cartridge printhead seal comprising:

a unitary elastomeric band forming an inkjet cartridge attaching portion and a seal portion, wherein the seal portion forms a sealing surface deflectable from a partially spherical shape to a generally flat shape when the elastomeric band is placed over an inkjet cartridge to seal a nozzle plate of the inkjet cartridge, and further wherein the inkjet cartridge attaching portion has a width that is narrower than a width of the sealing surface.

13. The inkjet cartridge printhead seal of claim 12, wherein the elastomeric band comprises a polymer having a silicone backbone.

14. The inkjet cartridge printhead seal of claim 12, wherein the elastomeric band comprises polydimethyl methyl vinyl silicone rubber.

15. The inkjet cartridge printhead seal of claim 12, wherein the seal portion is narrower than a maximum width of the elastomeric band.

16. The inkjet cartridge printhead seal of claim 12, wherein a connecting rib attaches the seal portion to the elastomeric band.

17. The inkjet cartridge printhead seal of claim 12, wherein the elastomeric band forms a depression near the seal portion, the depression forming a generally heart-shaped elastomeric band.

18. An inkjet cartridge printhead seal comprising:

an elastomeric band including an outer perimeter and an inner perimeter, the elastomeric band having a depression formed that reduces a diameter of both the inner perimeter and the outer perimeter;

a seal portion having a sealing surface, a generally flat band connecting surface opposite the sealing surface, a first seal portion wall connecting the sealing surface to the generally flat band connecting surface and a second seal portion wall generally opposite the first seal portion wall, the second seal portion wall connecting the sealing surface to the generally flat band; and a connecting rib being disposed between the elastomeric band and the seal portion.

19. The inkjet cartridge printhead seal of claim 18, wherein the elastomeric band, the seal portion, and the connecting rib are form a single piece.

20. The inkjet cartridge printhead seal of claim 18, wherein the elastomeric band has a cartridge attaching portion, the cartridge attaching portion being disposed on a portion of the band opposite the connecting rib.

* * * * *